US006965679B1

(12) United States Patent
Lopez Bosio et al.

(10) Patent No.: US 6,965,679 B1
(45) Date of Patent: Nov. 15, 2005

(54) EQUALIZABLE ELECTRO-ACOUSTIC DEVICE USED IN COMMERCIAL PANELS AND METHOD FOR CONVERTING SAID PANELS

(75) Inventors: Alejandro José Pedro Lopez Bosio, Saragossa (ES); Hernán Humberto Rojas Castillo, Saragossa (ES)

(73) Assignees: Alejandro Jose Pedro Lopez Bosio, Saragossa (ES), part interest; Electronica Integral de Sonido, S.A., Saragossa (ES), part interest ( * ) Notice: Subject to any disclaimer, the term of this patent is extended or adjusted under 35 U.S.C. 154(b) by 214 days.

(21) Appl. No.: 10/240,345

(22) PCT Filed: Oct. 17, 2000

(86) PCT No.: PCT/ES00/00399

§ 371 (c)(1),
(2), (4) Date: Oct. 1, 2002

(87) PCT Pub. No.: WO02/34007

PCT Pub. Date: Apr. 25, 2002

(51) Int. Cl.[7] ..... H04R 25/00

(52) U.S. Cl. ..... 381/152; 381/431

(58) Field of Search ..... 381/152, 396, 381/403, 420, 337, 431, 423, 426–428

(56) References Cited

U.S. PATENT DOCUMENTS

| | | | | |
|---|---|---|---|---|
| 3,449,531 A | | 6/1969 | Ashworth | |
| 3,636,281 A | | 1/1972 | Cozart | |
| 3,728,497 A | * | 4/1973 | Komatsu | 381/392 |
| 4,506,117 A | * | 3/1985 | Fresard | 381/162 |
| 4,675,907 A | * | 6/1987 | Itagaki et al. | 381/152 |
| 5,546,469 A | | 8/1996 | Donahoe | |
| 6,192,136 B1 | * | 2/2001 | Azima et al. | 381/338 |
| 6,332,029 B1 | * | 12/2001 | Azima et al. | 381/152 |
| 6,618,487 B1 | * | 9/2003 | Azima et al. | 381/152 |

* cited by examiner

*Primary Examiner*—Curtis Nuntz
*Assistant Examiner*—Phylesha Dabney
(74) *Attorney, Agent, or Firm*—Collard & Roe, P.C.

(57) ABSTRACT

Electro-acoustic device which when installed in continuous ceiling, partition or wall panels available in the market made of mineral fibre, plasterboard, multi-laminated wood, etc. converts them into flat, invisible radiators of high-fidelity sound by its special characteristic of being equalizable for each type of panel at the time of manufacture and assembly.

8 Claims, 3 Drawing Sheets

EQUALIZABLE ELECTRO-ACOUSTIC DEVICE USED IN COMMERCIAL PANELS AND METHOD FOR CONVERTING SAID PANELS

CROSS REFERENCE TO RELATED APPLICATIONS

Applicants claim priority under 35 U.S.C. §365 of PCT/ES00/00399 filed Oct. 17, 2000. The international application under PCT article 21 (2) was not published in English.

OBJECT OF THE INVENTION

The object of the present invention relates to an equalizable electro-acoustic device that is applied to commercial continuous ceiling, partition or wall panels, converting these to flat and invisible radiators of high-fidelity sound, that is, it relates to electro-acoustic transducers applied to environmental sound.

Its field of use is widespread, including public or private places such as shopping malls, airports, hospitals, supermarkets, churches, offices and homes, etc.

That is, by the present device it is intended that the commercial panels used in construction become high-fidelity diffusion devices, with the characteristic of being invisible.

Thus, the present invention lies in the field of sound diffusion, as well as that of continuous ceiling, partition or wall panels available in the market.

BACKGROUND OF THE INVENTION

Loudspeakers with a moving cone and coil are very old and have evolved little since their invention. To this date, the scheme is maintained of a cone of cardboard or paper that is driven by a coil in an intense magnetic field, which when excited by an alternating current makes the cone vibrate to thereby reproduce the sound.

As far as the authors of the present invention are aware, there is available in the market a flat loudspeaker of the American company Sound Advance that represents an evolution of the aforementioned loudspeakers. Sound Advance substituted the traditional cardboard or paper cone by a special panel with one flat face made of expanded polystyrene and which, by the special design of its rear face, allows the panel to reproduce the range of audio frequencies in an approximately linear fashion.

In this way, the flat speaker of Sound Advance is none other than a common magnetic system impelling a special panel whose acoustic characteristics are achieved by its particular design and construction. The achievement of Sound Advance was the design, formulation of the material and the construction of the special panel that confers its acoustic properties and simultaneously its flatness.

The present applicant has a patent application in Chile with application number 2598-99 in which is described an electromechanical and electromagnetic device that allows to transform an open roof panel or sandwich type panel of plaster and cardboard, commercialised under the name Pladur® into a high-fidelity electro-acoustic transducer.

In the device object of this patent the subtlest parameters have been handled, such as the shape and dimensions of the contact surfaces with the panel, as well as the nature of the adhesives used to attach it to said panel, the dimensions, shape and type of the materials of the component parts, particularly of the coupler, in order to provide an infinitely equalizable electro-acoustic device that allows obtaining a linear response (40–18,000 Hz±3 dB) from a common market-available continuous ceiling, partition or wall panel, made of materials such as mineral fibre, plasterboard, multi-laminated wood, etc. when suitably installed therein, thereby converting it into a high-fidelity flat radiator with wide dispersion and invisible in its place of installation.

DECRIPTION OF THE INVENTION

The object of this invention is an electro-acoustic transducer device which when installed in various types of commercial panels such as continuous ceiling, partition or wall panels of mineral fibre, plasterboard or multi-laminated wood up to 8 mm thick, etc., turns them into flat radiators of high-fidelity sound with a response of 40 to 18,000 Hz+3 dB and an efficiency above 86 dBWm. It consists of a chassis with bases that are adhered by an elastic adhesive to the panel, through which the sound is to be diffused. By means of a support the chassis at its center supports the magnetic system, which is similar to that of a medium power loudspeaker with the corresponding moving coil and centering membrane. The moving coil is near the rear face of the panel and is joined to it by a coupler that is glued with a stiff adhesive to both the moving coil and the panel.

By changing the size of the chassis (changing the distance between the supporting bases) the low-frequency response of the panel is changed both qualitatively and quantitatively.

By simultaneously varying the shape and nature of the coupler material the medium and high frequency response of the panel is changed both qualitatively and quantitatively.

According to the above, the device is equalizable at the time of manufacture and assembly, thus allowing to obtain a high-fidelity sound from available commercial continuous ceiling, partition or wall panels made of almost any type of material.

As the device is installed on the rear face of the panel, leaving its visible face unchanged, an invisible system is obtained that emits high-fidelity sound.

For panels with an audible resonance (such as plaster or gypsum) the device is coupled to a blanket of medium-density foam, such as self-adhesive polyurethane, that is glued to the plaster on its rear face in order to eliminate its audible resonance. The dimensions of this blanket are such that the rear face is completely covered by it. If the surface of the rear face is irregular (due to structural reinforcements) slits are provided to allow the blanket to adhere perfectly to the rear face of the panel.

DESCRIPTION OF THE DRAWINGS

Further characteristics and advantages of the present invention will become clearer in view of the following detailed description of a preferred embodiment of the invention, made with reference to the accompanying drawings, in which.

PREFERRED EMBODIMENT OF THE INVENTION

The drawings described above will be better understood in view of the following description of the elements that comprise and make possible the embodiment of the invention.

Figure 1:
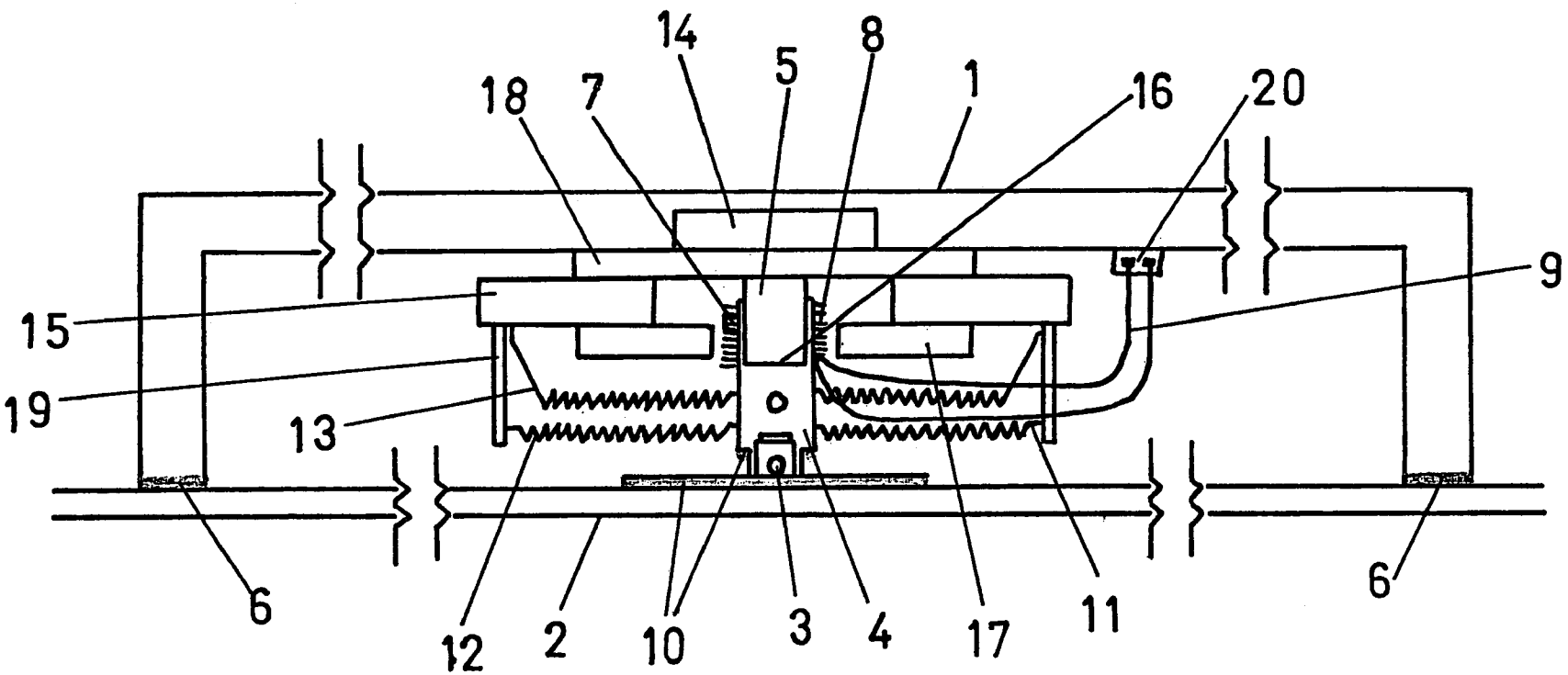
FIG. 1 represents a scheme of the principle of the electro-acoustic device.
Figure 2:
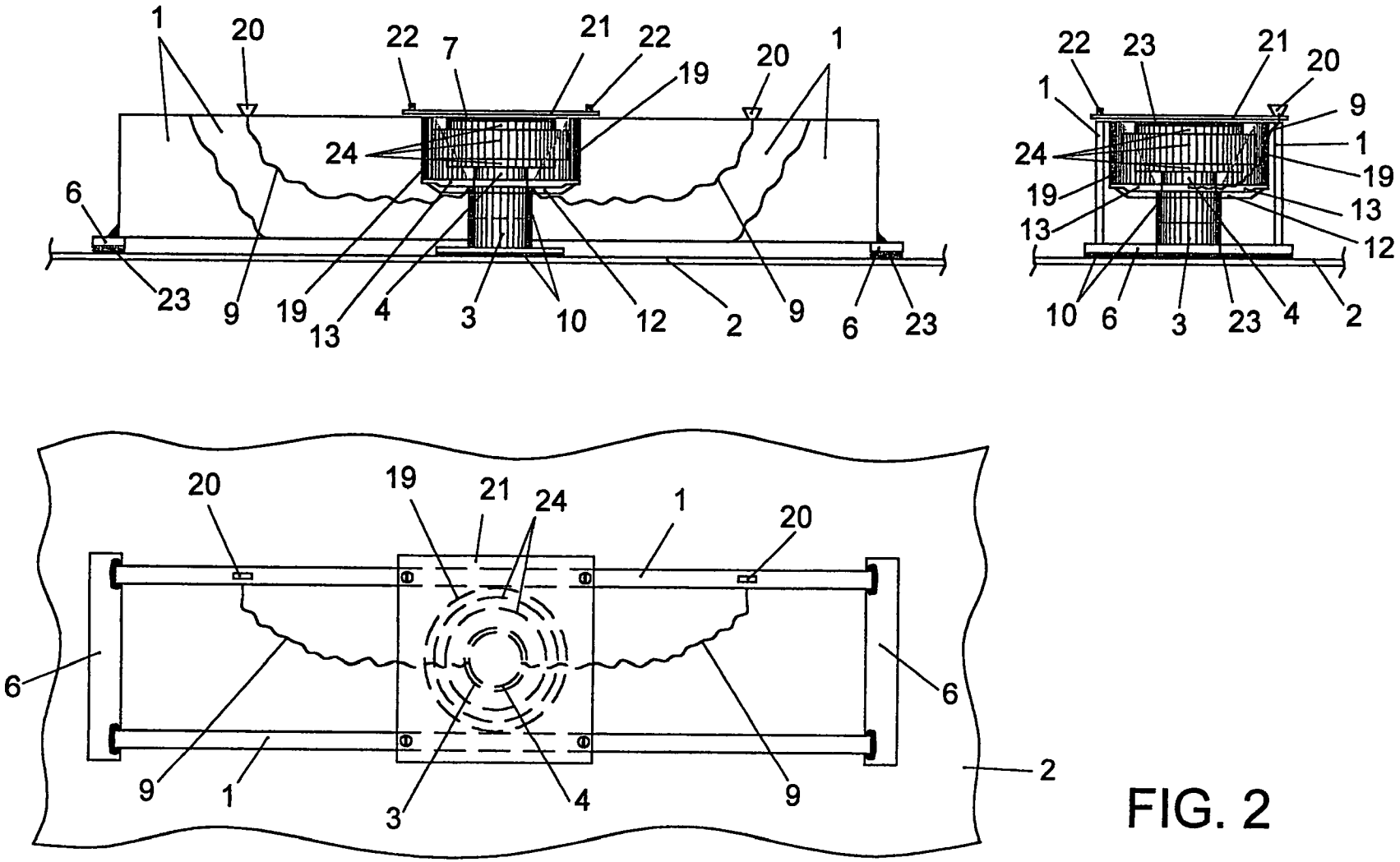
FIG. 2 represents a plan and profile elevation view of the electro-acoustic device in one example of a preferred embodiment.
Figure 3:
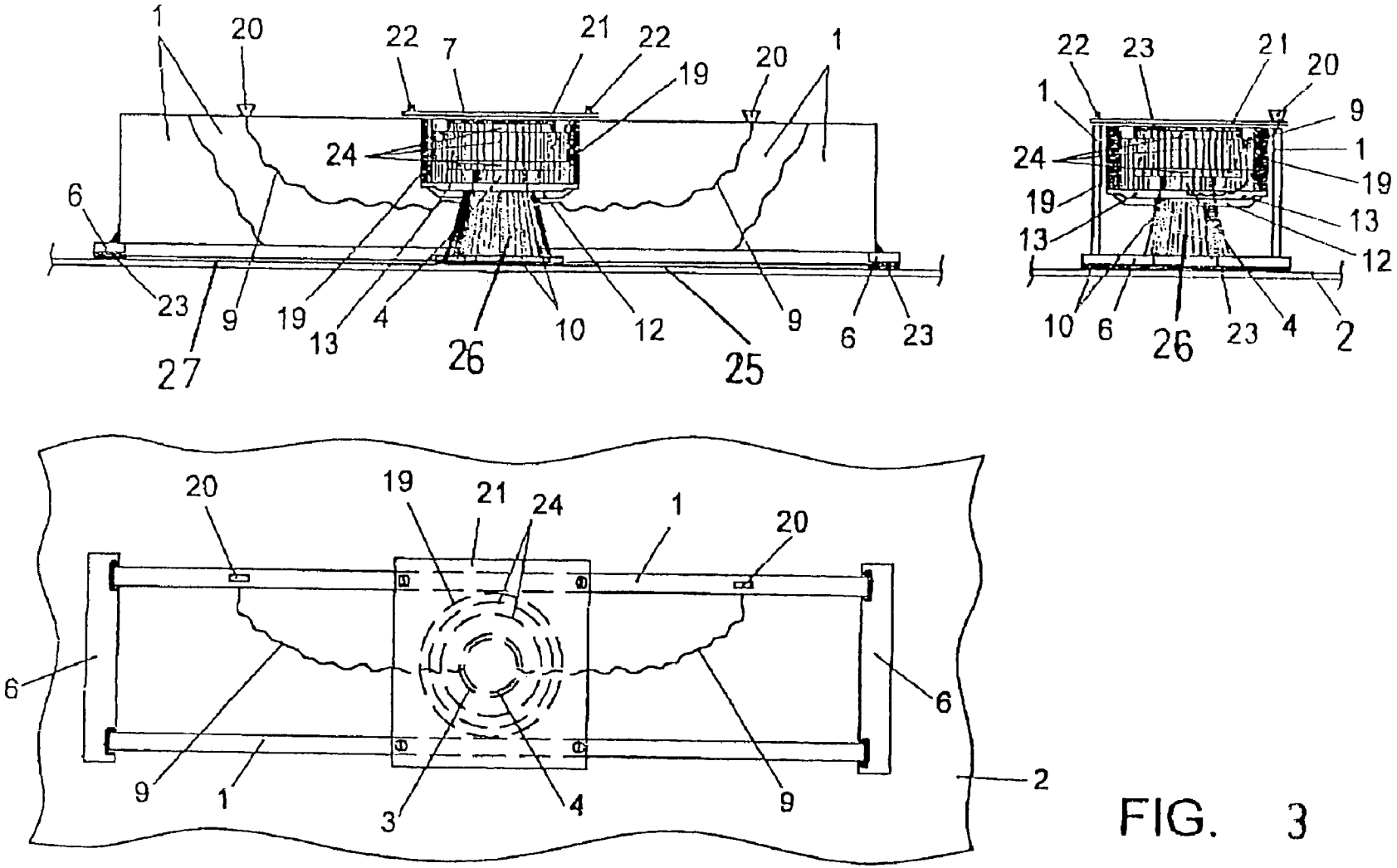
FIG. 3 represents a plan and profile elevation view of the electro-acoustic device in another embodiment of the invention.

FIG. 1 shows the composition of the electro-acoustic device, with a chassis (1) containing the magnets (14) and (15) that together with the polar elements (16), (17) and (18) and the magnet core (5) are in charge of creating an intense electromagnetic field in the air gap (8). The magnets (14) and (15), as well as the parts (16), (17) and (18) and the magnet core (5) form the magnetic system (24) (FIG. 2). By means of the centering membranes (12) and (13) and the bases of the centering membrane (19) it is possible to attach, elastically in an axial sense of the moving coil (4) and inelastically in a radial sense, thereby allowing to center the coil in the air gap (8). The moving coil (4), comprised of a coil body and a winding (7), ends at a coupler (3) that allows by means of a stiff adhesive (10) attachment to the panel (2) that is meant to carry out the sound diffusion driven by the device. The device is attached through its chassis (1) to the panel (2) by the support bases (6), for which an elastic adhesive (23) is employed (FIG. 2). The shape of the moving coil (4) transmits the impulses to the coupler (3) and this in turn, by means of the stiff adhesive (10) transmits them to the panel (2), which will vibrate. The coil (7) shall be connected to the source (sound amplifier) by flexible leads (9).

Both the elastic adhesive (23) (FIG. 2) and the stiff adhesive (10) are meant to be ultra-fast adhesives, so that in order to install the device it is sufficient to clean the rear surface of the panel (2) and then attach the device.

In order to balance the response of the electro-acoustic device between the low-frequency notes and the high- and mid- frequency notes, the coupler (3) is suitably sized by changing its dimensions and the material and shape of said coupler (3), as variations in the material and shape result in different responses to high and low frequencies.

Union (11) of the centering membrane (12) of the base (19) of the centering membrane is obtained by means of a stiff adhesive.

FIG. 2 shows that the electro-acoustic device is comprised of a chassis (1) made of metal or stiff plastic that supports, by means of the support (21) a magnetic system (24) similar to the magnet of a medium-power loudspeaker, with its moving coil (4) and its centering membranes (12) and (13) attached to the support (21) by the base of the centering membrane (19).

The shape of the chassis (1) is such that it has two support bases (6) in its ends, that are attached to the rear face of the panel (2) by an elastic adhesive (23), which in addition to keeping chassis (1) in place on the panel (2) allows it to vibrate.

The moving coil (4) remains centered in the magnetic system (24) by means of the centering membranes (12) and (13) and moves in its air gap (8)(FIG. 1) freely, transmitting its vibration to the panel (2) by the coupler (3).

The coupler (3) is a turned or injected part, similar to a hollow cylinder or truncated cone, with a flange on the end in contact with the panel (2). It is made of aluminium, hard plastic or ideally Kevlar® or titanium. Its mass must be minimum and its hardness extreme. The panel (2) will vibrate according to the vibration of the moving coil (4), producing the sound.

The moving coil (4) receives the alternating current (sound) from an amplifier through flexible leads (9) that are connected by the corresponding connectors (20).

The stiff adhesive (10) that joins the moving coil (4) to the coupler (3) and in turn said coupler (3) to the rear face of the panel (2) is stiff so that once hardened it will transmit very quickly the high-frequency vibrations of the moving coil (4) to the panel (2).

Thus the essence of the device has been described.

As the orifices for the adjusting and attachment screws (22) made in the support (21) have a greater diameter than said screws a fine-adjustment of the moving coil (4) in the air gap (8) is possible (FIG. 1), by small motions of the support (21) in relation to the chassis (1) until fully adjusting the clearness of a sound when a tone of for example 400 Hz is applied to the device by means of an amplifier.

It was experimentally confirmed that the device works in panels of various materials, such as mineral fibre, plasterboard, multi-laminated wood up to 8 mm thick, etc. It was also experimentally confirmed that all panels can be made to reproduce a frequency range from 40 to 18,000 Hz±3 dB by manipulating the dimensional and mechanical parameters as well as the nature of the materials of the device as follows: low notes can be equalized by separating or approximating the support bases (6) of the chassis (1). Mid notes can be equalized by changing the size of the coupler (3), as well as the contact surface (flange) of the coupler (3) to the rear face of the panel (2). High notes can be equalized by changing the hardness of the stiff adhesive (10) and the nature of the material that the coupler (3) is made of.

Thus, for example, if the panel is made of a multi-laminated wood the coupler (3) will have the form of a hollow cylinder with a flange on the end that is coupled to the panel (2), with which it is adhered by a stiff adhesive (10), with the coupler made of hard plastic. If the acoustic panel is made of Armstrong-type® mineral fibre the coupler (3) will be in the form of a hollow truncated cone with a flange on its end, being attached to the rear face of the panel (2) by a stiff adhesive (10), with the coupler (3) made of a material with characteristics similar to those of Kevlar® or titanium. For panels with an audible resonance (such as plaster or gypsum) the coupler (3) will have the form of a hollow cylinder with a flange on its end, attached to the rear face of the panel (2) by a stiff adhesive (10), with the coupler (3) made of a soft plastic material. In order to eliminate the resonance characteristic of these materials the rear face of the plaster or gypsum panel is coated with a medium-density, self-adhesive foam (27). If the panel is of the plaster and cardboard sandwich type (25) commercially known as Pladur®, a coupler is used with a hollow truncated cone (26) form with concave walls, with a flange on the end that is attached to the rear face of the panel (2) by a stiff adhesive (10), with the coupler (3) made of cardboard or a similar material.

In this way a device is obtained that after being equalized in the laboratory as described above for each type of panel can be reproduced with the optimal parameters obtained, copies of which can be used for industrial chain-production of sound panels of the same type as the one used in the equalization. With this method the constructive specifications of the device for each type of panel to be industrialized can be determined in the laboratory.

Finally, as the device is installed in the rear face of the panel, its visible face remains unchanged and including this device does has no aesthetic effect on it. Thus, a flat, high fidelity electro-acoustic device is provided that is invisible and has the same external appearance as the other panels forming the continuous ceiling.

The invention can be reduced to practice within its same essence by embodiments different from that provided by way of example of the invention, which shall also be protected by the protection sought herein. Likewise, it may be made in any shape and size with the most suitable materials as this is considered in the spirit of the claims.

What is claimed is:

1. An electro-acoustic device for installation on a continuous ceiling, partition or wall panel, comprising:

(a) a chassis comprising a plurality of support bases;

(b) a magnetic system disposed within said chassis comprising a moving coil; and (c) a coupler attached via an adhesive to said moving coil;

wherein said chassis is adapted to adhere via an adhesive through said support bases to a rear face of the panel and to allow the resulting sound emitted by the panel to equalize, so that its frequency range between 40 and 18,000 Hz is within ±3 dB, by manipulating its dimensional and mechanical parameters and the nature of the materials of the device; and wherein said coupler is made from a material having properties similar to those of Kevlar® or titanium, comprises a hollow truncated cone having a flange on an end of said cone adapted to adhere to the rear face of the panel via an adhesive, transmits at great speed all the vibrations of the moving coil to the panel, and allows obtaining a linear response regardless of the nature of the panel, for which the material or geometric shape are changed and adapted to obtain said linear response.

2. The electro-acoustic device according to claim 1, wherein the magnetic system includes centering membranes that are attached to a support at a centering membrane base, and with the moving coil centered in the magnetic system by means of the centering membranes it transmits the vibrations to the panel by the coupler.

3. An electro-acoustic device for installation on a continuous ceiling, partition or wall panel, comprising (a) a chassis comprising a plurality of support bases;

(b) a magnetic system disposed within said chassis comprising a moving coil;

(c) a coupler attached via an adhesive to said moving coil; and (d) a blanket of medium-density, self-adhesive foam disposed on said chassis;

wherein said chassis is adapted to adhere through said support bases and said blanket to a rear face of the panel to eliminate audible resonance inherent in the panel and to allow the resulting sound emitted by the panel to equalize, so that its frequency range between 40 and 18,000 Hz is within ±3 dB, by manipulating its dimensional and mechanical parameters and the nature of the materials of the device; and wherein said coupler is made of soft plastic material, comprises a hollow cylinder having a flange on an end of said cylinder adapted to adhere to the rear face of the panel via an adhesive, and transmits at great speed all the vibrations of the moving coil to the panel and allows obtaining a linear response regardless of the nature of the panel, for which the material or geometric shape are changed and adapted to obtain said linear response.

4. The electro-acoustic device according to claim 3, wherein if the rear face of the panel is irregular, the medium-density foam that coats the entire surface of said rear face of the panel is provided with slits that allow a perfect adherence of said blanket to the rear face of the panel.

5. An electro-acoustic device for installation on a continuous ceiling, partition or wall, comprising:

(a) a chassis comprising a plurality of support bases;

(b) a magnetic system disposed within said chassis comprising a moving coil; and (c) a coupler attached via an adhesive to said moving coil;

wherein said chassis is adapted to adhere through said support bases to a rear face of the panel and to allow the resulting sound emitted by the panel to equalize, so that its frequency range between 40 and 18,000 Hz is within ±3 dB, by manipulating its dimensional and mechanical parameters and the nature of the materials of the device; and wherein said coupler is made of a material having properties similar to those of cardboard, comprises a hollow truncated cone having concave walls and a flange on an end of said truncated cone adapted to adhere to the rear face of the panel via an adhesive, and transmits at great speed all the vibrations of the moving coil to the panel and allows obtaining a linear response regardless of the nature of the panel for which the material or geometric shape are changed and adapted to obtain said linear response.

6. An electro-acoustic device for installation on a continuous ceiling, partition or wall panel, comprising:

(a) a chassis comprising a plurality of support bases;

(b) a magnetic system disposed within said chassis comprising a moving coil;

(c) a coupler attached via an adhesive to said moving coil; and (d) a support attached to a plurality of centering membranes at a centering membrane base comprising a plurality of adjustment screws for adjustment of the support in relation to the chassis to make possible a fine-centering of the moving coil in an air gap;

wherein said chassis is adapted to adhere through said support bases to a rear face of the panel and to allow the resulting sound emitted by the panel to equalize so that its frequency range between 40 and 18,000 Hz is within ±3 dB, by manipulating its dimensional and mechanical parameters and the nature of the materials of the device; and wherein when centered in the magnetic system via the centering membranes, the moving coil transmits the vibrations to the panel by the coupler.

7. The electro-acoustic device according to claim 6, wherein the coupler allows obtaining a linear response regardless of the nature of the panel, for which the material or geometric shape are changed and adapted to obtain said linear response, using an adhesive to attach the panel to the coupler and the coupler in turn to the moving coil to thereby transmit at great speed all the vibrations of the moving coil to the panel.

8. The electro-acoustic device according to claim 7, wherein when the panel is made of multi-laminated wood the coupler is in the form of a hollow cylinder with a flange on its end that is adhered to the rear face of the panel by means of an adhesive, with the coupler made of hard plastic.

* * * * *